US010518538B2

(12) United States Patent
Kondo et al.

(10) Patent No.: US 10,518,538 B2
(45) Date of Patent: Dec. 31, 2019

(54) RECORDING APPARATUS

(71) Applicant: SEIKO EPSON CORPORATION, Tokyo (JP)

(72) Inventors: Manabu Kondo, Shiojiri (JP); Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/031,567

(22) Filed: Jul. 10, 2018

(65) Prior Publication Data

US 2019/0016132 A1 Jan. 17, 2019

(30) Foreign Application Priority Data

Jul. 12, 2017 (JP) ..... 2017-136276

(51) Int. Cl.
*B41J 2/165* (2006.01)
*B41J 11/00* (2006.01)

(52) U.S. Cl.
CPC ..... *B41J 2/16517* (2013.01); *B41J 11/0065* (2013.01)

(58) Field of Classification Search
CPC . B41J 11/0065; B41J 11/02; B41J 2/06; B41J 2002/14459; B41J 2202/20
USPC ..... 347/54, 55, 74, 76
See application file for complete search history.

(56) References Cited

U.S. PATENT DOCUMENTS

2003/0151639 A1 8/2003 Takahashi
2019/0016138 A1* 1/2019 Ito ..... B41J 2/1714

FOREIGN PATENT DOCUMENTS

JP 2004-202867 A 7/2004
JP 2007-076283 A 3/2007

* cited by examiner

*Primary Examiner* — An H Do
(74) *Attorney, Agent, or Firm* — Workman Nydegger

(57) ABSTRACT

An electric field generating unit that forms an electric field between a nozzle forming surface of a recording head and a medium support section that faces the nozzle forming surface by applying a voltage to a conductive member includes the conductive member, forms an electric field, and, during borderless recording in which ink is ejected on inside and outside of an edge of a paper sheet, applies an increased voltage in an ink discarded region outside the edge compared to a voltage applied in a recording region other than the ink discarded region.

6 Claims, 14 Drawing Sheets

RECORDING APPARATUS

BACKGROUND

1. Technical Field

The present invention relates to recording apparatuses that perform recording onto a medium by ejecting liquid.

2. Related Art

Recording apparatuses that perform recording onto a medium by ejecting liquid droplets (ink) as an example of liquid from a recording head include ink jet printers (hereinafter, also simply referred to as printers). In some printers, borderless recording, which is recording performed onto the entire surface of a medium, is available. In such printers, liquid droplets are discarded over the ends of a medium, which may cause ink mist to be generated and suspended into a space above the carriage on which the recording head is mounted. As a result, ink mist may be deposited on the ink cartridge mounted on the carriage. The mist deposited on the ink cartridge may get the user's hands dirty during exchange of ink cartridge.

JP-A-2004-202867 discloses a printer configured to generate potential difference between an absorption member that absorbs liquid droplets ejected onto a region outside the end of a medium and a nozzle forming surface of a recording head so as to actively attract liquid droplets discarded onto the region outside the end of a medium.

More specifically, the liquid droplets ejected from the nozzles of the recording head are elongated during flying, and separated to form main droplets formed of the heads of the droplets and satellite droplets following the main droplets. At least part of these satellite droplets drastically decreases in flying speed due to the viscous drag of air, and becomes mist before reaching the medium.

In a configuration in which a recording head is grounded and an electrode plate disposed to face the recording head is positively charged, negative charges are induced on the head portions (corresponding to main droplets) of liquid droplets ejected from the nozzles of the recording head, which are portions close to the electrode plate, due to electrostatic induction caused by positively charged electrode plate, while positive charges are induced on the tail portions which are opposite to the head portions and close to the recording head. Accordingly, when the tail portions of liquid droplets ejected from the nozzles are separated to form satellite droplets, these satellite droplets, which are positively charged, are directed toward the nozzle surface of the recording head while being repelled by the positively charged electrode plate, and deposited on the nozzle openings, which may cause occurrence of nozzle missing.

The above problem can be avoided if a potential difference is not applied between the recording head and the electrode plate. However, in this case, main droplets that form liquid droplets discarded over the ends of a medium and satellite droplets which are not positively charged cannot be actively attracted to the electrode plate. As a result, problems caused by mist generated due to borderless recording cannot be solved.

SUMMARY

An advantage of some aspects of the invention is that a recording apparatus which takes measures to address a problem of mist attached on the nozzle surface of the recording head due to formation of electric field and a problem caused by the mist generated during borderless recording is provided.

According to a first aspect of the present invention, a recording apparatus includes a recording head having a nozzle that ejects liquid onto a medium transported, and an electric field generating unit that forms an electric field between a nozzle forming surface of the recording head and a nozzle facing section that faces the nozzle forming surface, wherein the electric field generating unit has a conductive member and is configured to form an electric field between the nozzle forming surface and the nozzle facing section by applying a voltage to the conductive member, and, during borderless recording in which liquid is ejected on inside and outside of an edge of the medium, applies an increased voltage in a liquid discarded region outside the edge compared to a voltage applied in the recording region other than the liquid discarded region.

According to the above aspect, high mist attraction effect can be obtained in the liquid discarded region since the electric field generating unit applies an increased voltage in the liquid discarded region outside the edge compared to a voltage applied in the recording region other than the liquid discarded region during borderless recording. Further, a voltage applied in the recording region other than the liquid discarded region is lower than that in the liquid discarded region. Accordingly, deposition of mist onto the nozzle surface due to formation of an electric field between the nozzle forming surface and the nozzle facing section can be reduced. Accordingly, the recording apparatus which takes measures to address a problem of mist attached on the nozzle surface of the recording head due to formation of an electric field and a problem caused by the mist generated during borderless recording can be implemented.

In the above aspect of the present invention, the electric field generating unit applies an increased voltage in the end recording region inside the edge, in addition to the liquid discarded region, compared to a voltage applied in the recording region inside the end recording region.

According to the above aspect, the electric field generating unit applies an increased voltage in the end recording region inside the edge, in addition to the liquid discarded region, compared to a voltage applied in the recording region inside the end recording region. Accordingly, the liquid discarded outside the edge can be fully attracted toward the conductive member. In particular, even if the position of the medium is slightly deviated or different sizes of the media are used, the liquid discarded outside the edge can be fully attracted toward the conductive member.

In the above aspect of the present invention, the recording apparatus includes a carriage which includes the recording head and is configured to reciprocate in a scan direction of the recording head, wherein the electric field generating unit is configured to vary an applied voltage, and the voltage applied to the conductive member is changed depending on the position of the carriage.

According to the above aspect, the recording apparatus includes a carriage which includes the recording head and is configured to reciprocate in a scan direction of the recording head, wherein the electric field generating unit is configured to vary an applied voltage, and the voltage applied to the conductive member is changed depending on the position of the carriage. Accordingly, a configuration of the above aspect can be easily achieved.

In the above aspect of the present invention, a target of formation of the electric field by the electric field generating unit is thinned out during recording in a recording job that continuously performs recording on a plurality of media.

According to the above aspect, a target of formation of the electric field by the electric field generating unit is thinned out during recording in a recording job that continuously performs recording on a plurality of media. Accordingly, the frequency of formation of electric field can be reduced, and the occurrence of problems due to application of high voltage to the conductive member can be reduced.

In the above aspect of the present invention, voltage application to the conductive member is switched between on and off depending on a number of passes of reciprocation of the carriage.

According to the above aspect, voltage application to the conductive member is switched between on and off depending on a number of passes of reciprocation of the carriage. Accordingly, the frequency of formation of electric field can be reduced, and the occurrence of problems due to application of high voltage to the conductive member can be reduced.

In the above aspect of the present invention, the nozzle facing section includes an absorber that absorbs liquid.

According to the above aspect, the liquid attracted by the electric field can be absorbed by the absorber and collected.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

First, an outline of a recording apparatus according to a first embodiment of the present invention will be described.

Figure 1:
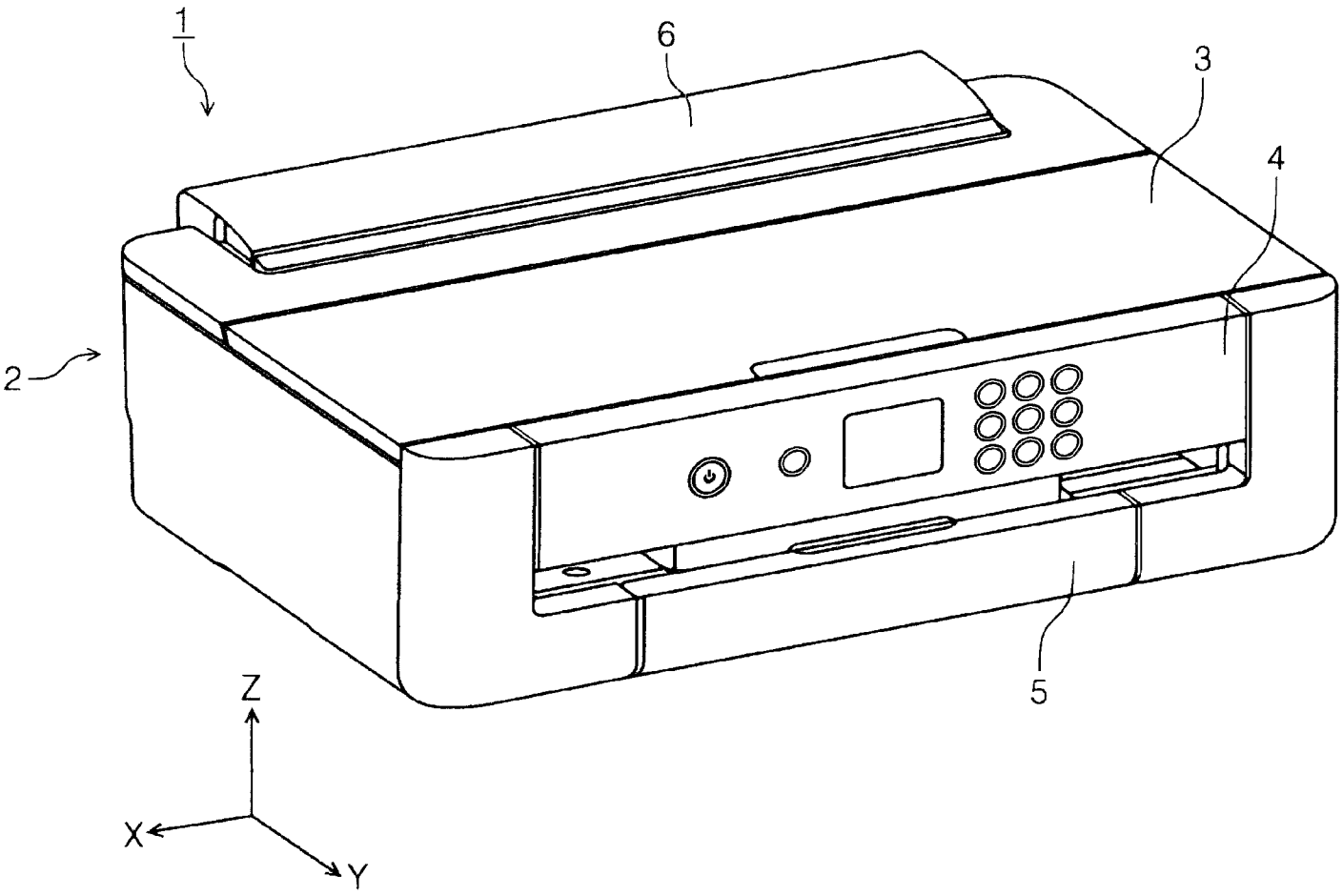
FIG. 1 is an outer appearance perspective view of a printer according to the present invention.
Figure 2:
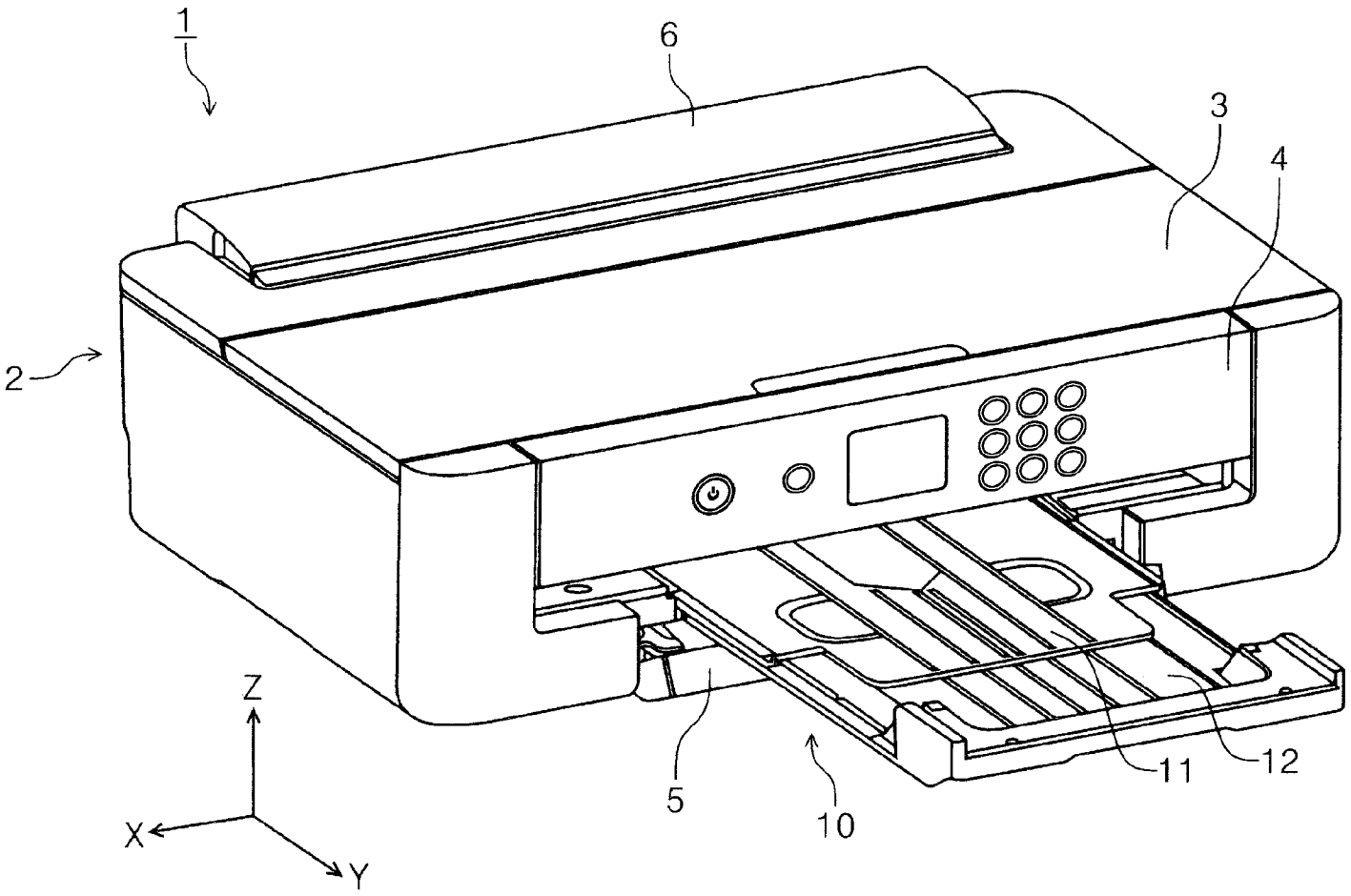
FIG. 2 is an exploded view of a sheet output tray of a printer according to the present invention.
Figure 3:
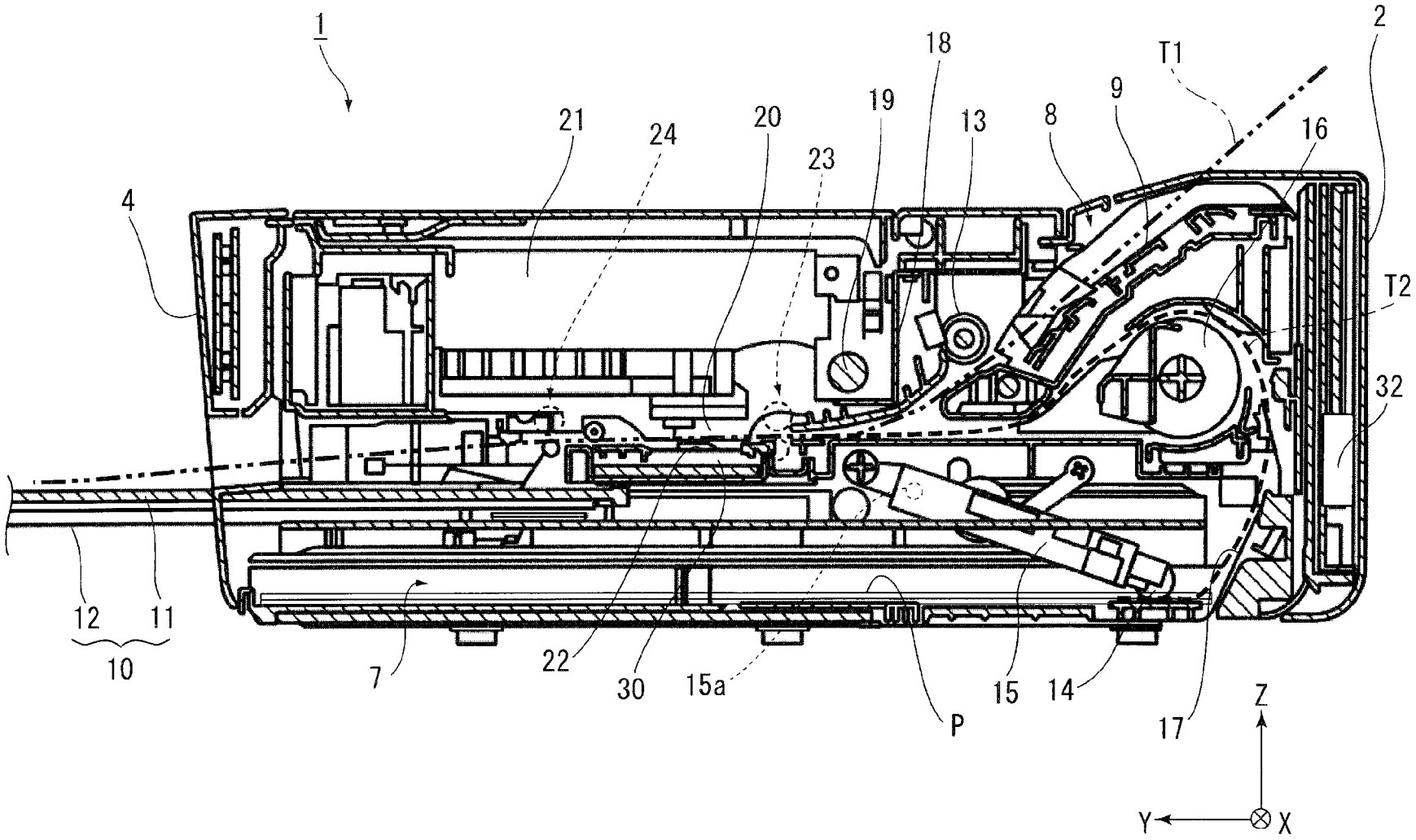
FIG. 3 is a view which illustrates a paper sheet transport path of a printer according to the present invention.
Figure 4:
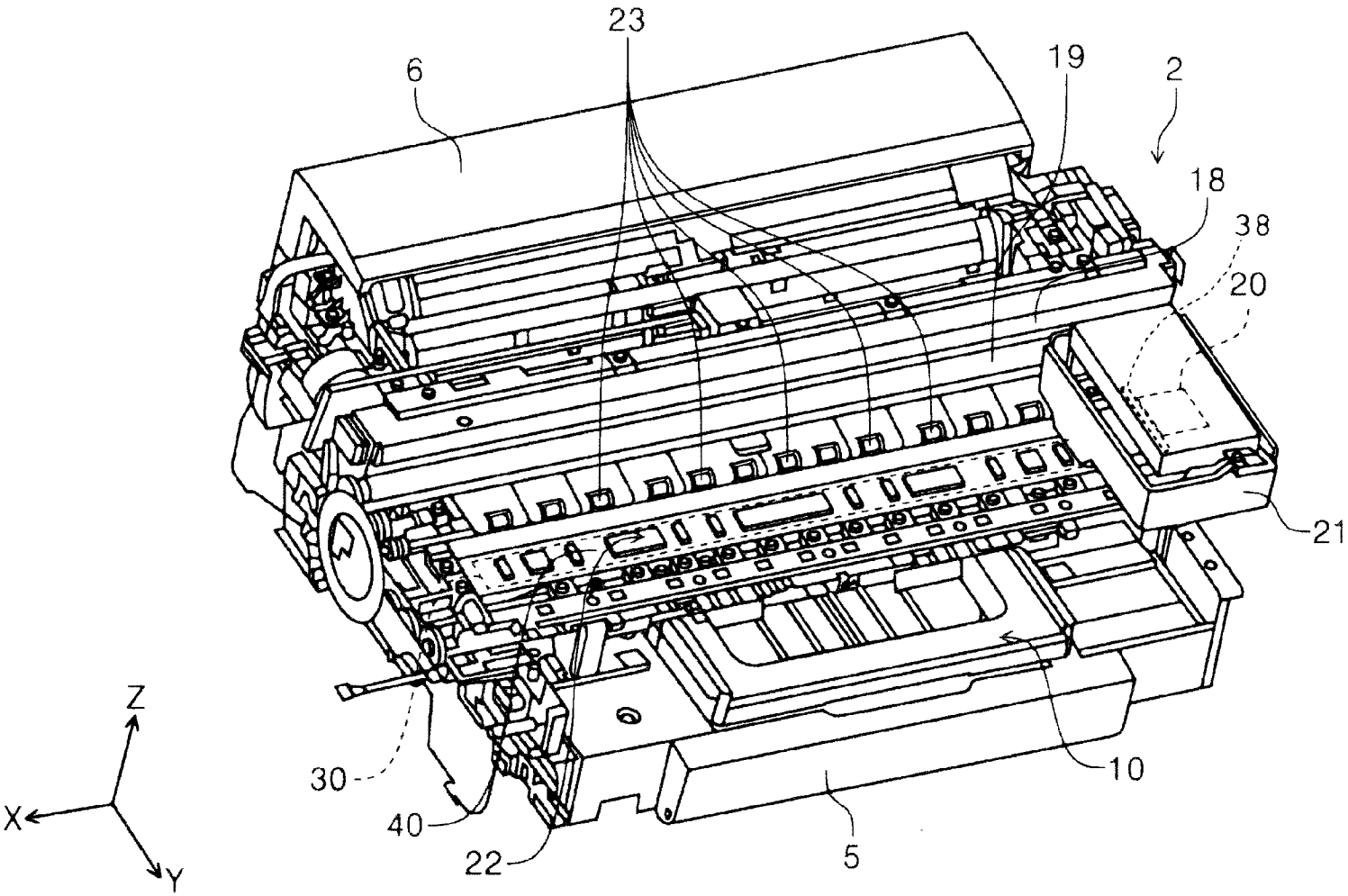
FIG. 4 is a perspective view of an apparatus main body with an outer case removed.
Figure 5:
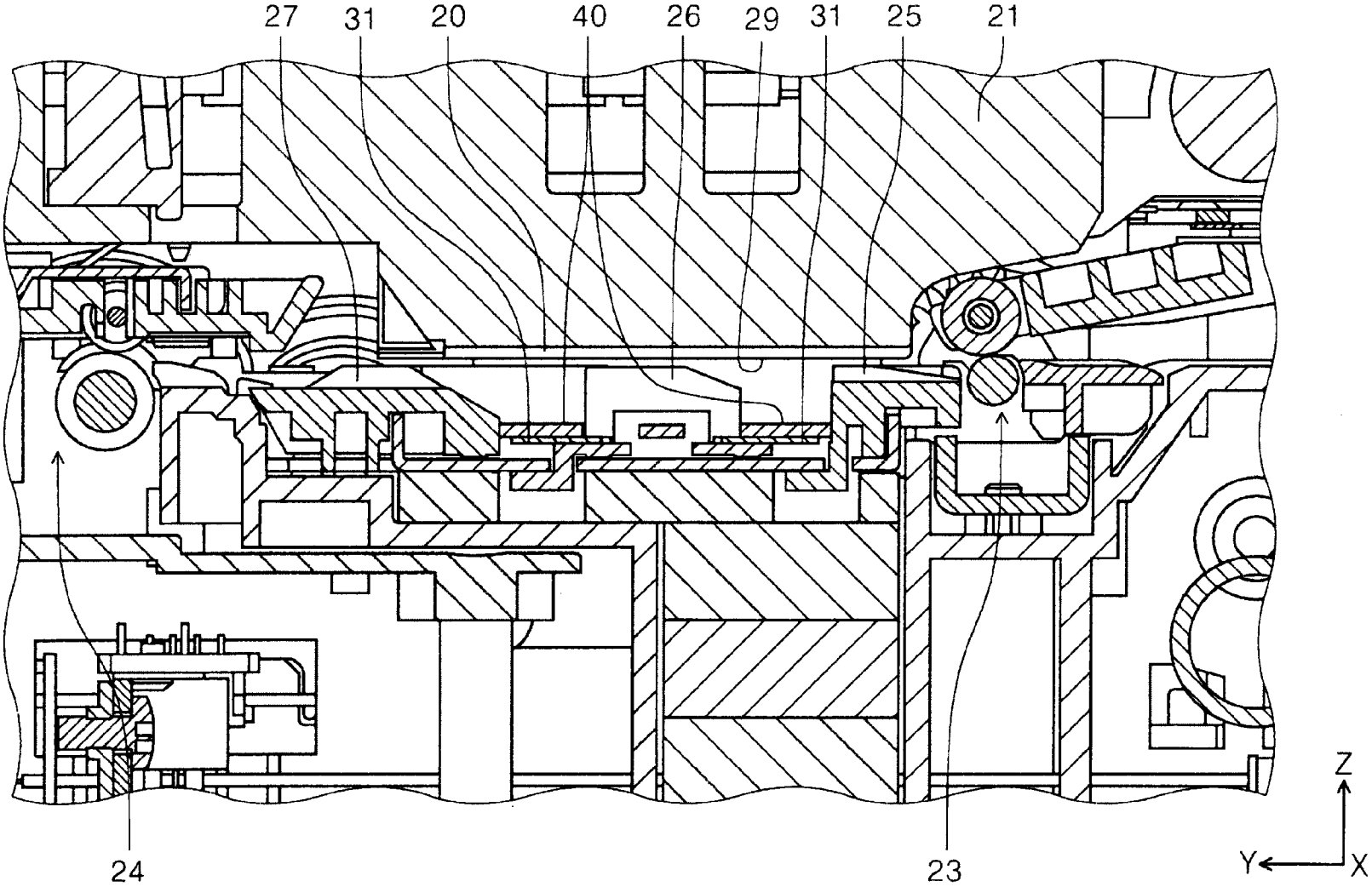
FIG. 5 is a side cross-sectional view of a recording head and surroundings of the medium support section.
Figure 6:
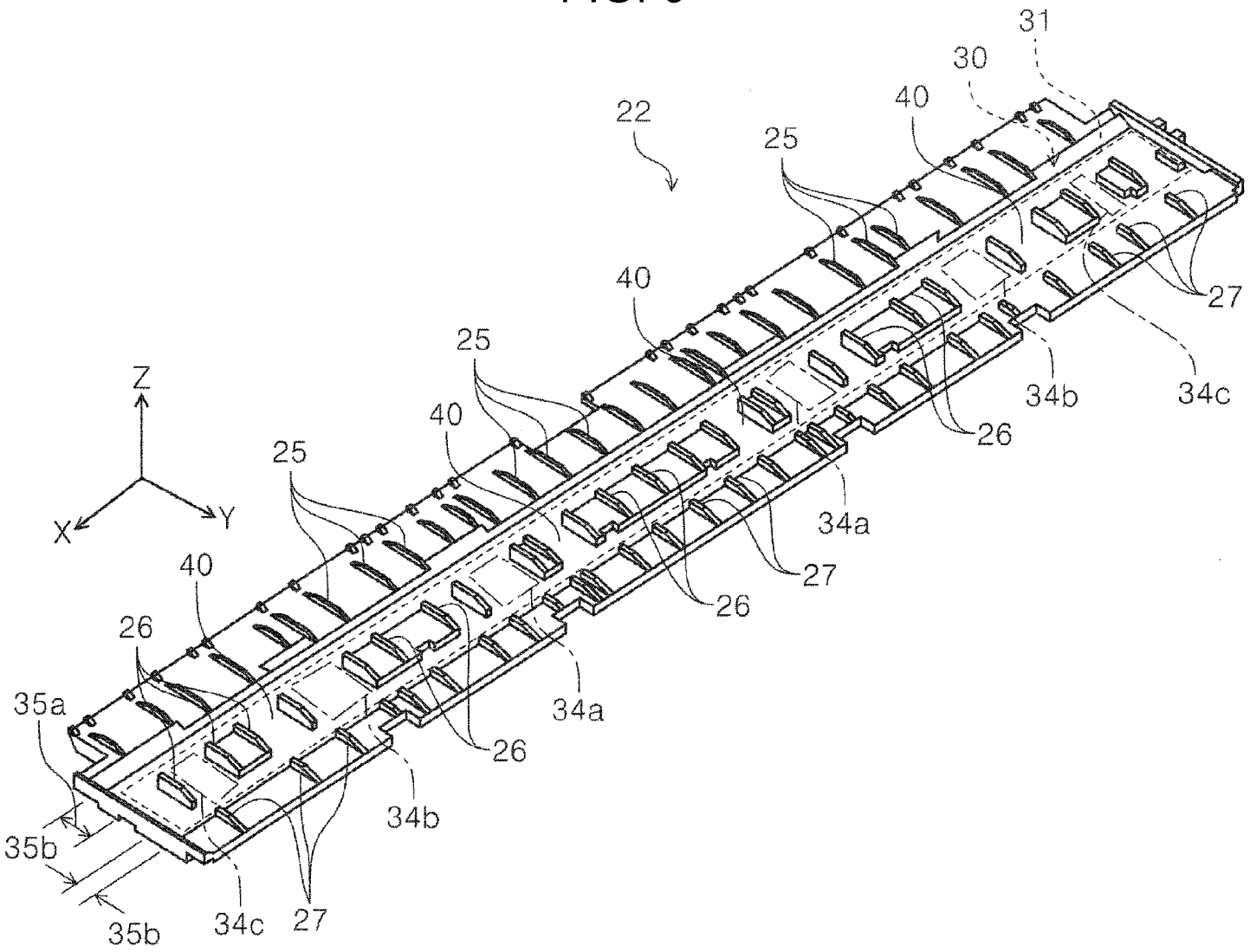
FIG. 6 is a perspective view of a medium support section.

In the present embodiment, an ink jet printer 1 (hereinafter, simply referred to as a printer 1) will be described as an example of a recording apparatus. FIG. 1 is an outer appearance perspective view of a printer according to the present invention. FIG. 2 is an exploded view of a sheet output tray of a printer according to the present invention. FIG. 3 is a view which illustrates a paper sheet transport path of a printer according to the present invention. FIG. 4 is a perspective view of an apparatus main body with an outer case removed. FIG. 5 is a side cross-sectional view of a recording head and surroundings of the medium support section. FIG. 6 is a perspective view of a medium support section.

Figure 7:
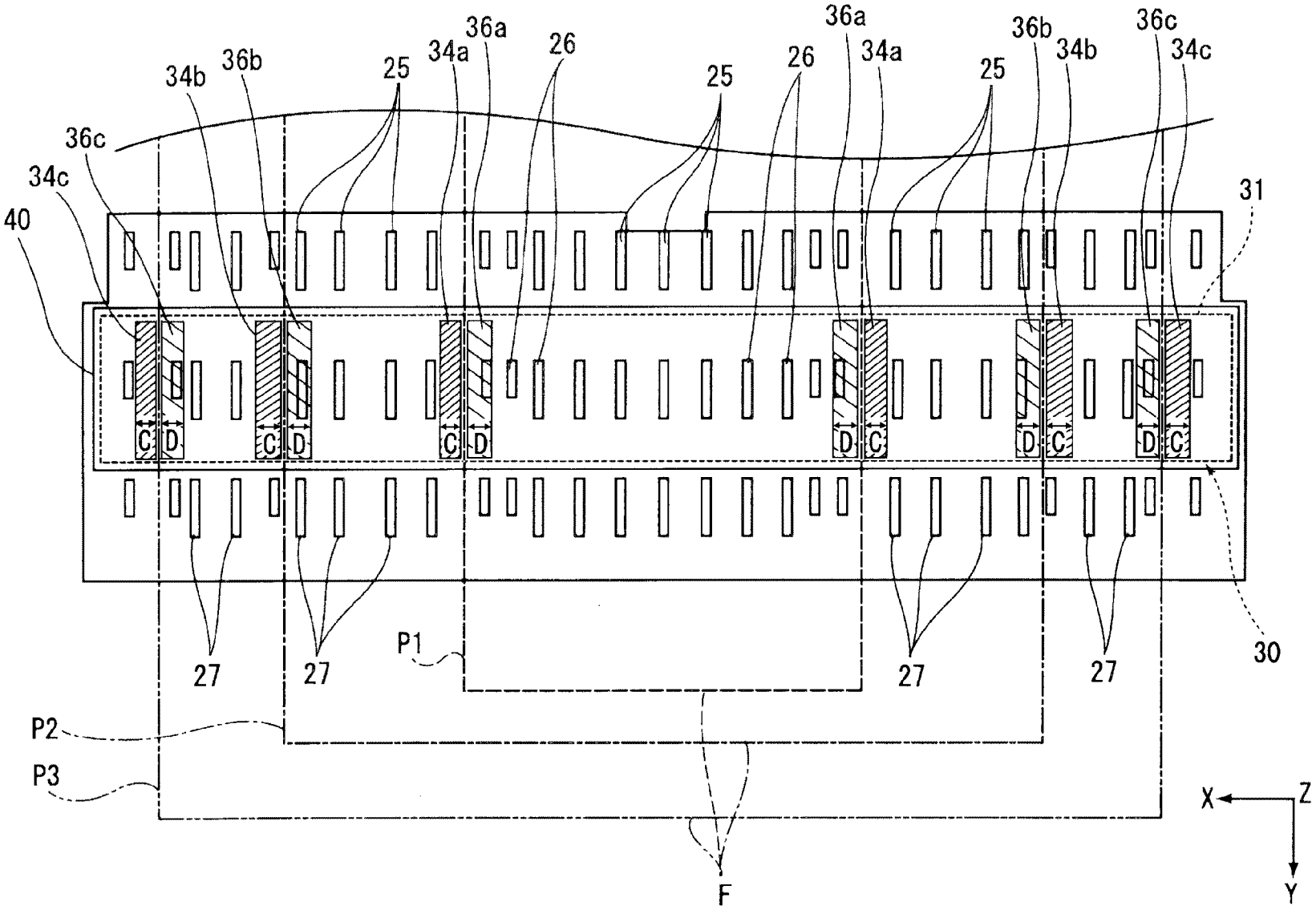
FIG. 7 is a schematic plan view of a medium support section, which illustrates that borderless recording is performed in a region between the leading end and the trailing end of a paper sheet.
Figure 8:
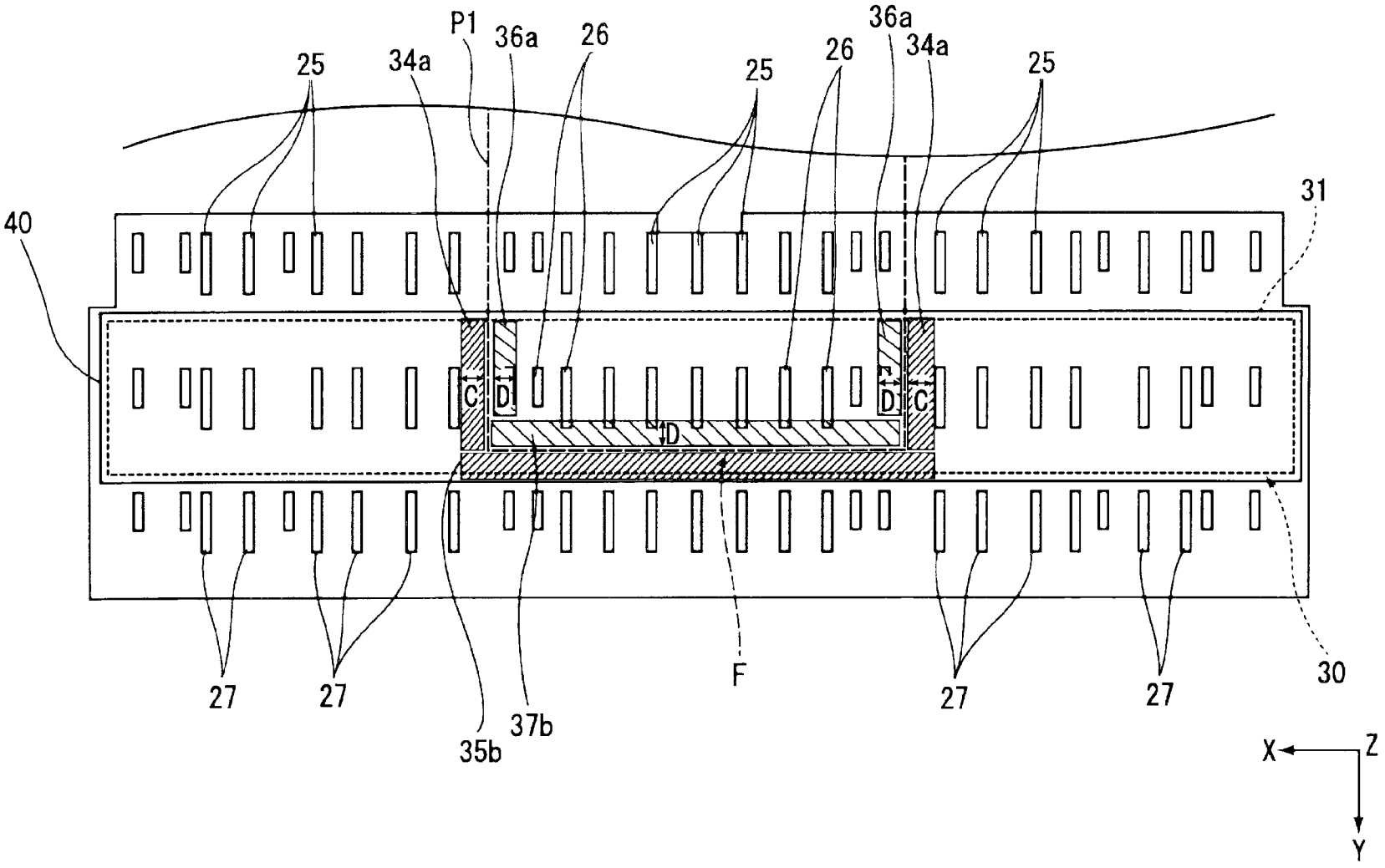
FIG. 8 is a schematic plan view of a medium support section, which illustrates that borderless recording is performed on the leading end of a paper sheet.
Figure 10:
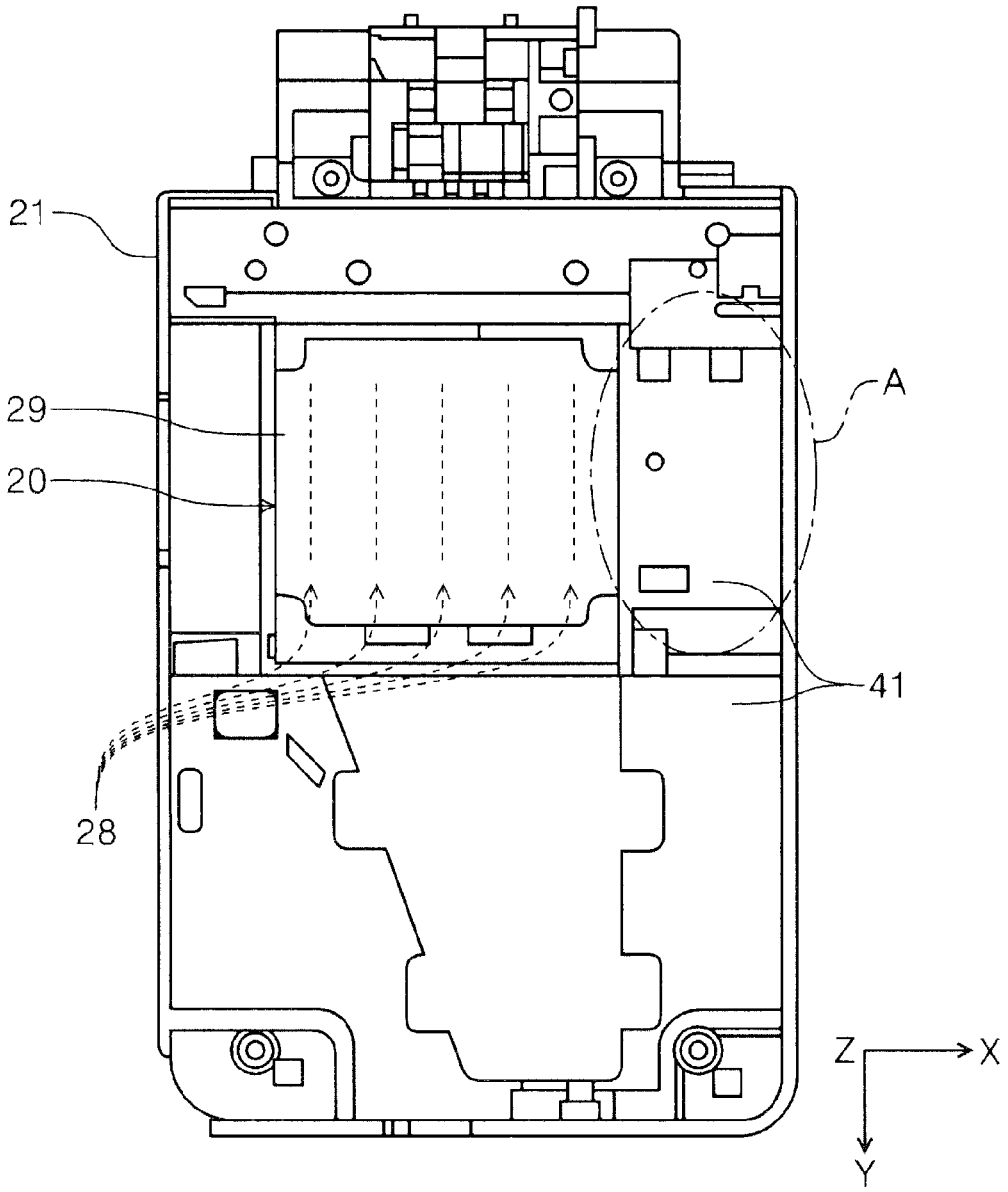
FIG. 10 is a view of a carriage as viewed from the bottom.
Figure 11:
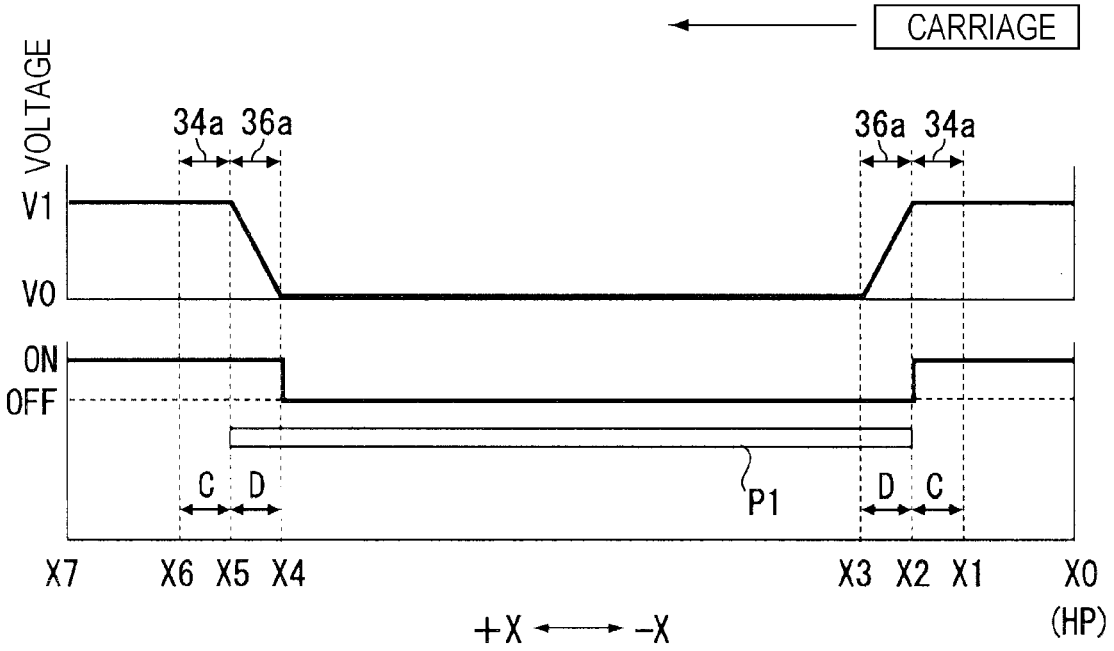
FIG. 11 is a view which illustrates an operation of an electric field generating unit during borderless recording.
Figure 12:
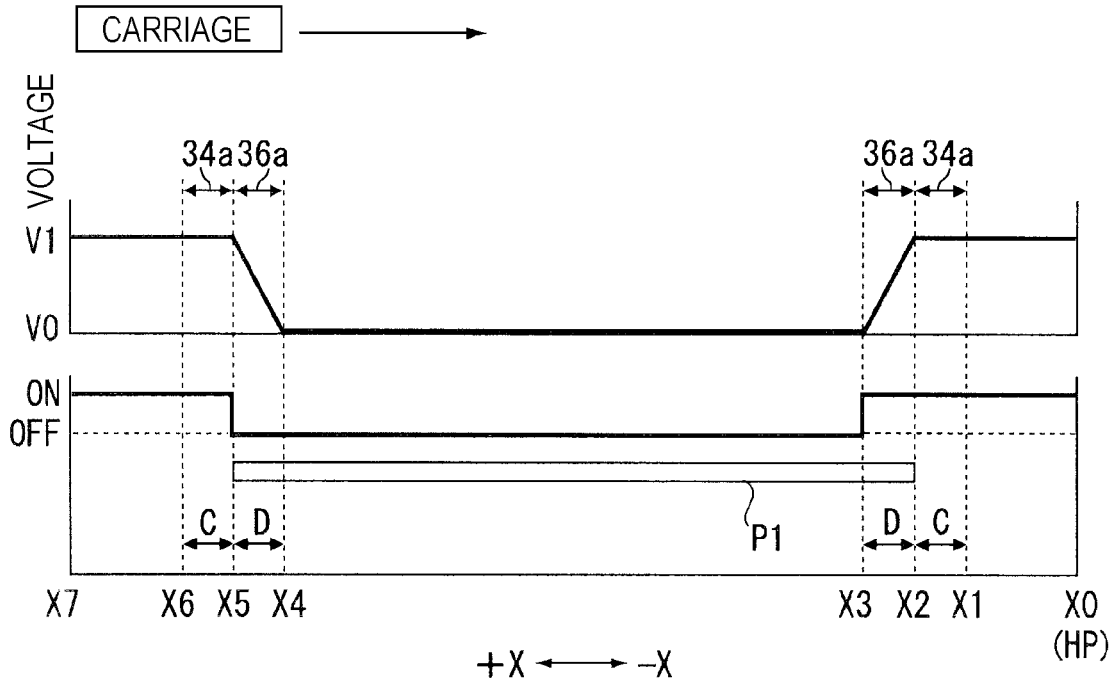
FIG. 12 is a view which illustrates an operation of an electric field generating unit during borderless recording.
Figure 13:
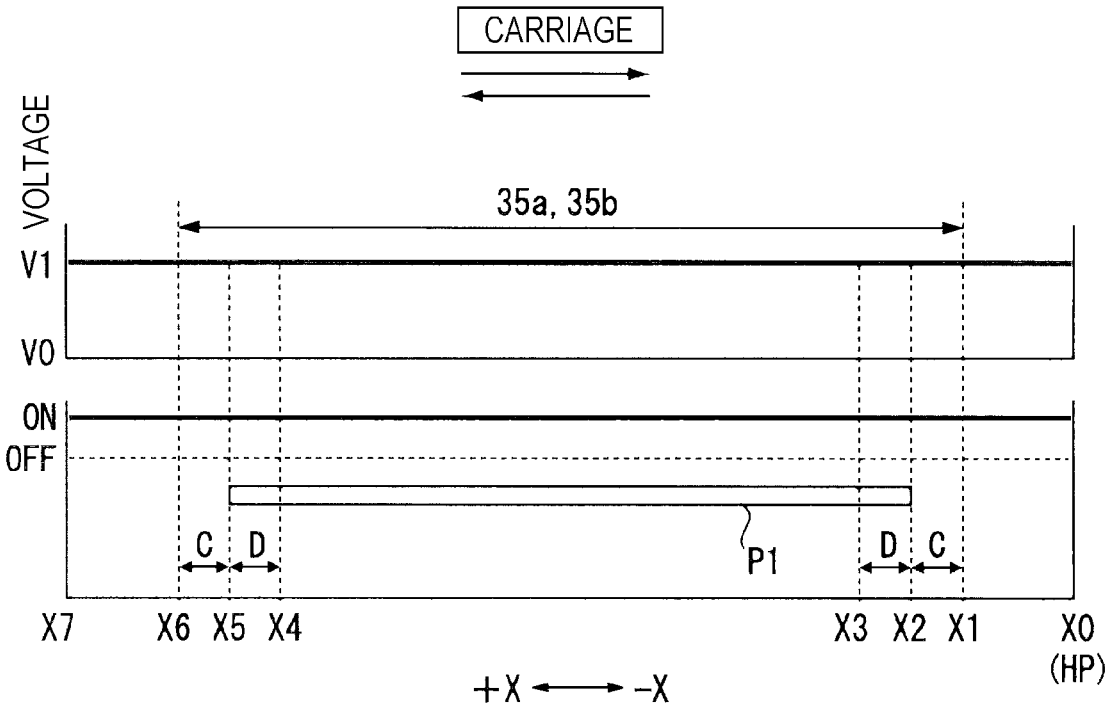
FIG. 13 is a view which illustrates an operation of an electric field generating unit during borderless recording.

FIG. 7 is a schematic plan view of a medium support section, which illustrates that borderless recording is performed in a region between the leading end and the trailing end of a paper sheet. FIG. 8 is a schematic plan view of a medium support section, which illustrates that borderless recording is performed on the leading end of a paper sheet. FIG. 8 is a schematic plan view of a medium support section, which illustrates that borderless recording is performed on the trailing end of a paper sheet. FIG. 10 is a view of a carriage as viewed from the bottom. FIGS. 11 to 13 are views which illustrate operations of an electric field generating unit during borderless recording.

In the X-Y-Z coordinate system shown in each drawing, the X direction is an apparatus width direction and the Y direction is an apparatus depth direction. The Z direction is a gravity direction, which indicates an apparatus height direction. Further, +Y direction is an apparatus front side, and −Y direction is an apparatus back side. Further, as viewed from the apparatus front side, the left side is +X direction and the right side is −X direction. Further, +Z direction is an apparatus upper side (including the upper part, top surface, and the like), and −Z direction is an apparatus lower side (including the lower part, bottom surface, and the like). In addition, the direction to which a paper sheet is transported in the printer 1 is referred to as "downstream," and the opposite direction is referred to as "upstream."

Overall Configuration

With reference to mainly FIGS. 1 to 3, an overall configuration of the printer 1 according to the present invention will be described. The printer 1 shown in FIG. 1 includes a recording head 20 (FIG. 3) in an apparatus main body 2, and the recording head 20 performs ink jet recording onto a paper sheet which is an example of a medium. The recording head 20 includes nozzle rows 28 (FIG. 10) each having an array of nozzles that eject ink as an example of liquid onto a paper sheet transported.

As shown in FIG. 1, a main body cover 3 is disposed on the upper part of the apparatus main body 2 so as to openably close the apparatus main body 2. The main body cover 3 can be opened to expose the inside of the apparatus main body 2, which allows for exchange of ink cartridges (reference number is omitted) mounted on a carriage 21 (FIG. 3) having a recording head 20, maintenance for removing a paper jam in the paper sheet transport path, and the like.

As shown in FIG. 1, the apparatus front surface of the printer 1 is provided with an operation panel 4 having a power supply button, operation buttons for various print settings and recording execution, a display that displays the print settings determined, and the like. Further, a front cover 5 is provided on the apparatus front surface in an openable manner. The front cover 5 can be opened to expose a sheet supply tray 7 (FIG. 3) and a sheet output tray 10 (FIGS. 2 and 3), which are described later, that receives paper sheets outputted from the apparatus main body 2 after recording.

The sheet output tray 10 (FIGS. 2 and 3) includes the first tray 11 and the second tray 12 that can be displaced in a medium output direction (+Y axis direction). The sheet output tray 10 is configured to receive the paper sheets outputted after recording when expand from a housed state (FIG. 1) in which the entire sheet output tray 10, that is, both the first tray 11 and the second tray 12 are housed in the apparatus main body 2 to an expanded state (FIG. 2) in which the first tray 11 and the second tray 12 are displaced in the medium output direction (+Y axis direction). Further, the sheet output tray 10 can also receive the paper sheets outputted when only the second tray 12 is displaced in the medium output direction (+Y axis direction) and the first tray 11 remains in the housed state.

Moreover, the sheet supply tray 7 shown in FIG. 3 can house a plurality of paper sheets. The sheet supply tray 7 is detachable from the apparatus main body 2. Further, in FIG. 1, reference character 6 designates an openable rear cover disposed on the upper rear part of the apparatus main body 2. The rear cover 6 can be opened to supply paper sheets by using a rear sheet supply section 8 (FIG. 3).

Paper Sheet Transport Path in Printer

Next, with reference mainly to FIG. 3, a paper sheet transport path in the printer 1 will be described. First, the description will be made on paper sheet feeding from the rear sheet supply section 8, and then paper sheet feeding from the sheet supply tray 7 disposed on the bottom of the apparatus. In FIG. 3, a paper sheet transport path T1 from the rear sheet supply section 8 is indicated by the dot-dot-dashed line. Further, a paper sheet transport path T2 from the sheet supply tray 7 to an upstream side of a pair of transport rollers 23 is indicated by the dotted line.

The rear sheet supply section 8 includes a setting section 9 that supports a plurality of paper sheets set thereon. The paper sheets set on the setting section 9 are fed downstream as the uppermost paper sheet is picked up by a first feed roller 13. The setting section 9 is configured as a swingable hopper that can advance and withdraw the leading end (downstream end) of the paper sheets with respect to the first feed roller 13 depending on the number of paper sheets set thereon. The pair of transport rollers 23 rotated by a motor, which is not shown, is provided ahead of the first feed roller 13 so that the paper sheet is fed to under the recording head 20.

The recording head 20 is disposed exposed to a bottom 41 (FIG. 8) of the carriage 21 such that the carriage 21 is driven by a motor, which is not shown, to reciprocate in a scan direction, which is the X axis direction. The carriage 21 is guided by a guide shaft 19 disposed on the guide frame 18 to move in the X axis direction (see also FIG. 4). A medium support section 22 is disposed as an example of "nozzle facing section" at a position facing the nozzle forming surface 29 (FIG. 8) of the recording head 20. The recording head 20 performs recording by ejecting ink as an example of liquid onto a paper sheet supported by the medium support section 22.

When ink is ejected from the recording head 20 for recording onto a paper sheet, electrically charged ink mist (hereinafter, also simply referred to as mist) may be separated from the ink droplets and suspended. An electric field generating unit 30 that forms electric field between the nozzle forming surface 29 and the medium support section 22 by applying a voltage to a conductive member 31 (FIG. 5) is provided on the medium support section 22 so that mist originated from ink ejected from the recording head 20 is attracted in a direction away from the recording head 20. As shown in FIG. 5, the conductive member 31 is disposed under the medium support section 22. The voltage applied to the conductive member 31 is controlled by a control section 32 (FIG. 3).

Moreover, the medium support section 22 includes a first absorber 40 (FIG. 5) that absorbs ink and mist so that the mist and ink discarded during borderless recording by which recording is performed without margin on the edge (side edge) of the paper sheet are absorbed by the first absorber 40 and collected. In the present embodiment, as shown in FIG. 5, the first absorber 40 is provided on the conductive member 31. The details of the configuration of the electric field generating unit 30 and the first absorber 40 disposed on the medium support section 22 will be described later.

A pair of output rollers 24 rotated by a motor, which is not shown, is provided on the downstream side of the medium support section 22. After recording is performed by the recording head 20, the paper sheet is outputted by the pair of output rollers 24 to the aforementioned sheet output tray 10.

Further, the printer 1 can feed the paper sheets one by one from the sheet supply tray 7. The sheet supply tray 7 houses a plurality of paper sheets P. The sheet supply tray 7 is slidingly movable between a feedable position (FIG. 3) and a retreated position (not shown) in which the sheet supply tray 7 has been moved to the apparatus front surface side (in FIG. 3, +Y axis direction in which the sheet supply tray 7 is withdrawn).

In FIG. 3, a second feed roller 14 is provided on a roller support member 15 that swings about a rotation shaft 15*a*. The second feed roller 14 is configured to be in contact with the uppermost sheet among the paper sheets P housed in the sheet supply tray 7 and rotate to thereby feed out the uppermost sheet from the sheet supply tray 7 when located at an end position in which the sheet supply tray 7 has been slid to the rearmost position in the apparatus (in FIG. 3, −Y axis direction, which is a mounting direction of the sheet supply tray 7 and also a paper sheet feeding direction). The paper sheet P fed out by the second feed roller 14 is fed upward along an inclined surface 17 that forms a transport path surface.

An intermediate roller 16 rotated by a motor, which is not shown, is provided on the downstream side of the second feed roller 14 and the inclined surface 17 so that the paper sheet is curved and reversed by the intermediate roller 16 and fed toward the front side of the apparatus.

The paper sheet fed along the transport path T2 indicated by the dotted line merges with the transport path T1 (dot-dot-dashed line) at a position before the pair of transport rollers 23. On the subsequent downstream side, the paper sheet is transported by the pair of transport rollers 23 as with the paper sheet fed out from the rear sheet supply section 8, and outputted toward the sheet output tray 10 by the pair of output rollers 24 after recording is performed by the recording head 20.

Moreover, in double-sided recording of the paper sheet, the paper sheet, after having recording performed on the front surface by the recording head 20, is switchbacked and advanced into transport path T2 from under the intermediate roller 16 to be curved and reversed for recording on the rear surface of the paper sheet.

Medium Support Section and First Absorber

Referring now to FIGS. 5 and 6, the medium support section 22 and the first absorber 40 will be described. As shown in FIGS. 5 and 6, the medium support section 22 includes a plurality of first rib 25 that are spaced from each other in the width direction (X axis direction) perpendicular to the paper sheet transport direction. On the downstream side of the respective first ribs 25, a plurality of second ribs 26 that are spaced from each other in the width direction as with the first ribs 25 are provided. Furthermore, on the downstream side of the respective second ribs 26, a plurality of third ribs 27 that are spaced from each other in the width direction are provided. The paper sheet transported is supported from the underside by the first ribs 25, the second ribs 26, and the third ribs 27.

The first absorber 40 is disposed in the medium support section 22. The first absorber 40 is disposed at least in a liquid discarded region (in FIG. 6, regions indicated by reference characters 34*a*, 34*a*, 34*b*, 34*b*, 34*c*, and 34*c* and regions indicated by reference characters 35*a* and 35*b*) outside the edge of the paper sheet during borderless recording in which ink is ejected on both the inside and outside the edge (side edge) of the paper sheet so as to absorb the discarded ink.

In the medium support section 22, the liquid discarded regions in the paper sheet width direction are, for example, regions indicated by reference characters 34*a*, 34*a*, 34*b*, 34*b*, 34*c*, and 34*c* in FIG. 6. The liquid discarded regions 34*a* and 34*a*, the liquid discarded regions 34*b* and 34*b*, and the liquid discarded regions 34*c* and 34*c* each correspond to the positions of both edges in the width direction of the paper sheets having predetermined widths (for example, the paper sheets P1 to P3 having different widths, see FIG. 7).

Figure 9:
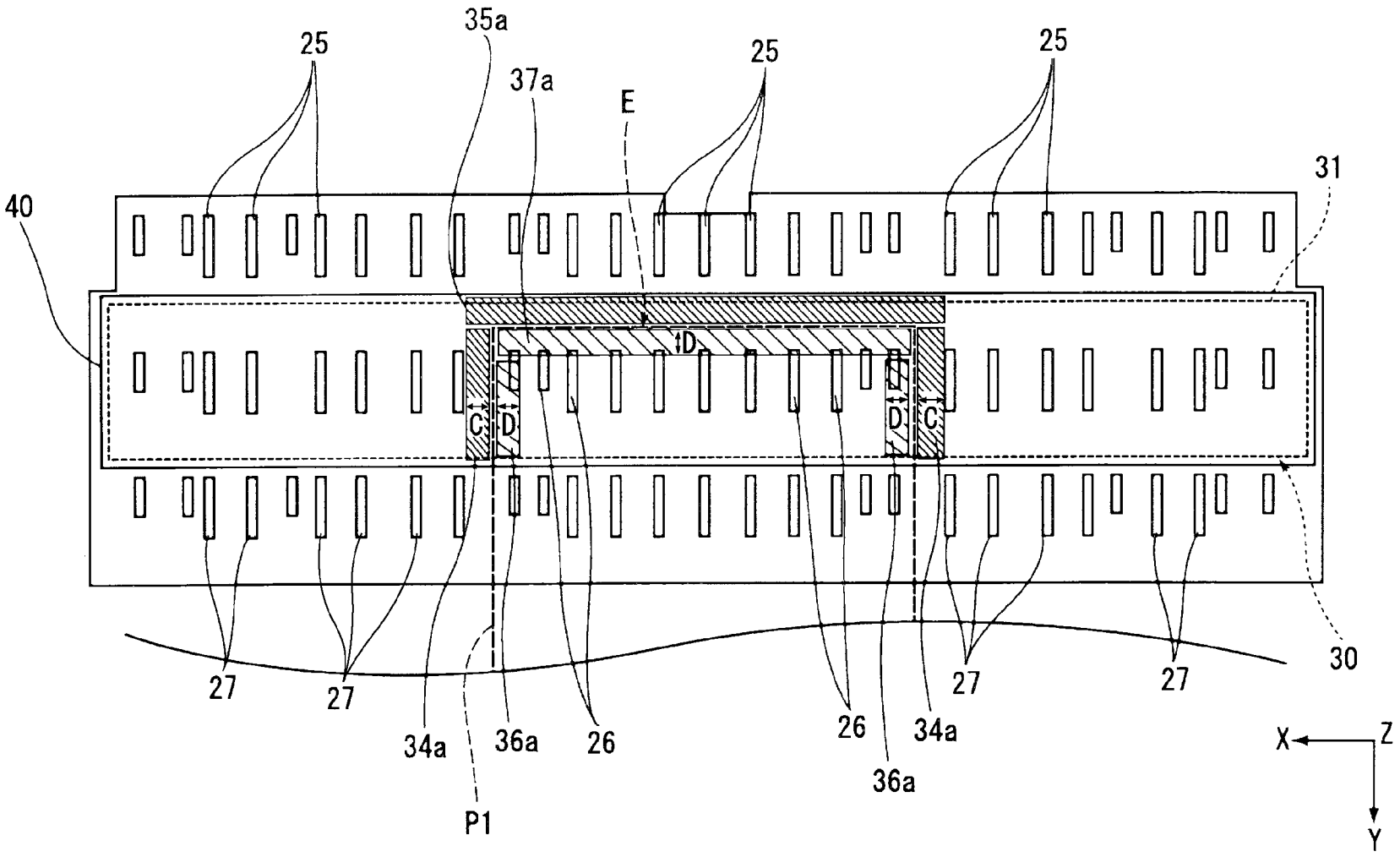
FIG. 9 is a schematic plan view of a medium support section, which illustrates that borderless recording is performed on the trailing end of a paper sheet.

Further, the liquid discarded regions in the Y axis direction in the transport direction of the paper sheet are a liquid discarded region 35*a* in which the region between the first rib 25 and the second rib 26 shown in FIG. 6 corresponds to outside the edge of the trailing end in the transport direction of the paper sheet and a liquid discarded region 35*b* in which the region between the second rib 26 and the third rib 27 corresponds to outside the edge of the leading end in the transport direction of the paper sheet. FIG. 8 shows that borderless recording is performed on the leading end of a paper sheet P1 of a predetermined size. FIG. 9 shows that borderless recording is performed on the trailing end of the paper sheet P1.

The first absorber 40 is formed of, for example, a porous member such as a non-woven fabric or polymer material. The first absorber 40 absorbs ink discarded during borderless recording.

Electric Field Generating Unit

As described above, the electric field generating unit 30 that forms an electric field between the nozzle forming surface 29 and the medium support section 22 by applying a voltage to the conductive member 31 is provided on the medium support section 22 (FIGS. 5 and 6) that faces the recording head 20. In the present embodiment, as shown in FIG. 5, the conductive member 31 is provided under the first absorber 40. As a voltage is applied to the conductive member 31 to form an electric field between the conductive member 31 and the recording head 20, mist generated during ejection of ink from the recording head 20 is attracted to the conductive member 31. The mist attracted to the conductive member 31 is absorbed by the first absorber 40 and collected.

Here, during borderless recording, the electric field generating unit 30 is configured to apply an increased voltage in the ink liquid discarded region outside the edge of the paper sheet (in FIG. 6, the liquid discarded regions 34*a*, 34*b*, and 34*c*, and the liquid discarded regions 35*a*, and 35*b*) compared to a voltage applied in the recording region other than the ink liquid discarded region, that is, a voltage applied to the paper sheet. This configuration is a characterizing part of the present invention. In other words, the applied voltage is changed depending on whether it is the ink liquid discarded region or the recording region during borderless recording.

Specifically, the electric field generating unit 30 is configured to vary a voltage applied to the conductive member 31 by control of the control section 32 so that the voltage is changed depending on the position of the carriage 21. Now referring to FIGS. 7 to 9 and FIGS. 11 to 13, an operation of the electric field generating unit 30 depending on the position of the carriage 21 will be described.

In FIGS. 11 to 13, the horizontal axis corresponds to the movement region of the carriage 21, in which the left side on the drawing is +X axis direction and the right side on the drawing is −X axis direction. The position X0 on the end in the −X axis direction is a home position (HP) of the carriage 21, and the position X7 on the end in the +X axis direction is the end position of the movement region of the carriage 21, which is opposite to the home position. FIGS. 11 to 13 show the relationship of the switching between on and off of the voltage application to the conductive member 31 depending on the position of the carriage 21 (lower chart in the drawings) and the change in voltage actually applied to the conductive member 31 (upper chart in the drawings) during borderless recording performed on the paper sheet P1 shown in FIGS. 7 to 9.

As shown in FIG. 7, when recording is performed on the region between the leading end F and the trailing end E of the paper sheet P1 (not shown in FIG. 7, see FIG. 9), ink is discarded onto the liquid discarded regions 34*a* and 34*a* on both ends in the width direction (X axis direction) of the paper sheet P1 (FIG. 7).

Movement of Carriage from Home Position to +X Axis Direction Side

When the carriage 21 moves from the home position to the +X axis direction side (see FIG. 11), the voltage application to the conductive member 31 by the control section 32 is on during the time in which the carriage 21 moves from the home position (position X0) to the edge of the paper sheet P1 in the −X axis direction (position X2). That is, while the carriage 21 moves outside the paper sheet P1 in the −X axis direction (including the liquid discarded region 34*a*), an electric field is generated between the carriage 21 and the conductive member 31 so that negatively charged mist is attracted toward positively charged conductive member 31. The mist attracted to the conductive member 31 is absorbed by the first absorber 40 (FIG. 5). The voltage applied during on-time to the conductive member 31 is referred to as V1.

Further, the liquid discarded region 34*a* is a region from the edge of the paper sheet P1 (for example, position X2) to the position X1 spaced by a distance C.

When the carriage 21 reaches the edge (position X2) of the paper sheet P1 in the −X axis direction, the control section 32 turns off the voltage application to the conductive member 31. The voltage to the conductive member 31 does not become zero (V0) at the instant of turning off the voltage application, but gradually decreases over a certain period of time. In the present embodiment, the voltage applied to the conductive member 31 decreases to V0 during the period in which the carriage 21 moves from the position X2 to the position X3. The position X3 is a position inwardly spaced from the position X2 (edge of the paper sheet P1 in the −X axis direction) by a distance D. The region between the position X2 and the position X3 is referred to as an end recording region 36*a* (see also FIG. 7).

When the carriage 21 moves to the position X3, the voltage applied to the conductive member 31 decreases to V0. The control section 32 maintains the voltage application to the conductive member 31 to be off until the carriage 21 reaches the position X4. The position X4 is a position spaced from the edge position X5 of the paper sheet P1 in the +X axis direction toward inside the paper sheet P1 by a distance D. The region between the position X4 and the position X5 is also referred to as an end recording region 36*a* (see also FIG. 7) as with the region between the position X2 and the position X3. Further, in FIG. 7, reference character 36*b* indicates an end recording region 36*b* on the paper sheet P2, and reference character 36*c* indicates an end recording region 36*c* on the paper sheet P3.

When the carriage 21 reaches the position X4, the control section 32 again turns on the voltage application to the conductive member 31. When the voltage application is switched from off to on, the voltage applied to the conductive member 31 gradually increases from V0 to V1 over a certain period of time as with the case in which the voltage application is switched from on to off. The widths (distance D) of the end recording regions 36 in the +X axis direction and the −X axis direction are so determined that the time required for an increase of the voltage when the voltage application is switched from off to on is the same as the time required for a decrease from on to off. Accordingly, the voltage applied to the conductive member 31 becomes V1 during the period in which the carriage 21 moves from the position X4 to the position X5 (edge position of the paper sheet P1 in the +X axis direction).

Then, the voltage application to the conductive member 31 is maintained to be on during the period in which the carriage 21 moves from the position X5 to the position X7 (end of the movement region of the carriage 21 in the +X axis direction). Here, the voltage applied to the conductive member 31 becomes V1 in the liquid discarded region 34*a* in the +X axis direction (region from the position X5 to the position X6 which is spaced toward the outside the paper sheet P1 by the distance C). Accordingly, an electric field is generated between the carriage 21 and the conductive member 31 in the liquid discarded region 34*a* so that negatively charged mist can be attracted toward positively charged conductive member 31. Thus, the electric field generating unit 30 operates while the carriage 21 moves from the home position in the +X axis direction.

As described above, high mist attraction effect can be obtained in the liquid discarded region 34*a* and 34*a* since the electric field generating unit 30 is configured to apply an increased voltage in the liquid discarded region 34*a* and 34*a* compared to a voltage applied in the recording region other than the liquid discarded region 34*a* and 34*a* during borderless recording. Further, in the recording region other than the liquid discarded region 34*a* and 34*a*, that is, the region in which the paper sheet is positioned on the conductive member 31 (the region from the position X2 to the position X5), the voltage applied to the conductive member 31 is lower than that in the liquid discarded region 34*a* and 34*a*. Accordingly, deposition of mist onto the nozzle forming surface 29 due to formation of an electric field between the nozzle forming surface 29 and the medium support section 22 can be reduced. Accordingly, the recording apparatus 1 which takes measures to address a problem of mist attached on the nozzle surface 29 of the recording head 20 due to formation of an electric field and a problem caused by the mist generated during borderless recording can be implemented.

Moreover, the operation of the electric field generating unit 30 described in conjunction with FIG. 11 enables to apply an increased voltage in the end recording regions 36*a* and 36*a* inside the edge of the paper sheet P1, in addition to the liquid discarded regions 34*a* and 34*a*, compared to a voltage applied in the recording region inside the end recording regions 36*a* and 36*a* (in FIG. 11, between the position X3 and the position X4). Accordingly, the ink discarded outside the paper sheet can be fully attracted toward the conductive member 31. In particular, even if the position of the paper sheet is slightly deviated or different sizes of the paper sheets are used, the ink discarded outside the edge can be fully attracted toward the conductive member 31.

For the clarity of description, the voltage applied when the voltage application to the conductive member 31 is turned off has been described as zero (V0). However, the voltage applied in the recording region inside the liquid discarded region 34*a* may be a value lower than that in the liquid discarded region 34*a* outside the edge of the paper sheet (that is, may not be necessarily zero).

Further, the control of the voltage applied to the conductive member 31 is preferably performed by pulse width modulation (PWM) control. By performing PWM control, the applied voltage can be controlled with high accuracy and stability.

Movement of Carriage from +X Axis Direction Side to Home Position

While the carriage 21 moves from the end in the +X axis direction (position X7) to the home position, the operation of the electric field generating unit 30 described above of the carriage 21 moving from the home position to the +X axis direction side can be performed from the opposite side. That is, as shown in FIG. 12, the voltage application to the conductive member 31 is on during the time in which the carriage 21 moves from the position X7 (the end of the movement region of the carriage 21 in the +X axis direction) to the position X5 (edge position of the paper sheet P1 in the +X axis direction), and the voltage application to the conductive member 31 is turned off when the carriage 21 reaches the position X5. Then, the off-state is maintained until the carriage 21 reaches the position X3 (before entering the end recording region 36*a*). When the carriage 21 reaches the position X3, voltage application to the conductive member 31 again turned on. Accordingly, a configuration can be implemented in which the voltage V1 is applied in the liquid discarded region 34*a* and 34*a*, and a voltage lower than the voltage V1 applied in the liquid discarded region 34*a* and 34*a* is applied in the region inside the edge of the paper sheet P1, while an increased voltage is applied in the end recording regions 36*a* and 36*a* inside the edge of the paper sheet P1 compared to a voltage applied in the recording region inside the end recording regions 36*a* and 36*a* (in FIG. 12, between the position X4 and the position X3).

Performing Borderless Recording on Leading End or Trailing End of Paper Sheet

FIG. 13 is a view which illustrates an operation of the electric field generating unit 30 when borderless recording is performed on the leading end F of the paper sheet P1 (FIG. 8) and when borderless recording is performed on the trailing end E of the paper sheet P1 (FIG. 9). When borderless recording is performed on the leading end F or the trailing end E of the paper sheet P1, the liquid discarded region 35*a* (FIG. 9) and the liquid discarded region 35*b* (FIG. 8) extends across the width direction of the paper sheet. Accordingly, during borderless recording on the leading end F or the trailing end E of the paper sheet P1, the voltage application to the conductive member 31 by the electric field generating unit 30 is constantly turned on (FIG. 12) while the carriage 21 reciprocates between the home position (position X0) and the end in the +X axis direction (position X7). Accordingly, the mist generated during borderless recording on the leading end F or the trailing end E of the paper sheet P1 can be efficiently attracted to the conductive member 31 and absorbed by the first absorber 40 (FIG. 5).

Further, a voltage applied to the conductive member 31 in the end recording region 37*b* (FIG. 8) on the leading end F of the paper sheet P1 and inside the liquid discarded region 35*b* (FIG. 8), and the end recording region 37*a* (FIG. 9) on the trailing end E of the paper sheet P1 and inside the liquid discarded region 35*a* (FIG. 9) are lower than the liquid discarded regions 35*a* and 35*b*, and higher than the region between the end recording region 37*a* and the end recording region 37*b*. Accordingly, the ink discarded outside the paper sheet P1 can be fully attracted toward the conductive member 31.

The recording head 20 of the present embodiment is a serial type recording head in which the recording head 20 mounted on the carriage 21 reciprocates in a direction perpendicular to the medium transport direction while ejecting ink onto a paper sheet to thereby perform recording. However, a line head in which nozzles for ejecting ink are provided to cover the entire width of the paper sheet may also be used. When the recording head is a line head, an electric field generating unit can be provided with, for example, a plurality of conductive members that can individually control a voltage to be applied to a portion corresponding to the liquid discarded region, a portion corresponding to the end recording region, and a portion corresponding to the other recording region.

Conductive Member

In the present embodiment, the conductive member 31 is formed as a plate member having a flat surface. If the conductive member 31 has an irregular surface, the first absorber 40 disposed on the conductive member 31 follows the shape of the irregularity and forms the recesses and projections on the surface of the first absorber 40. If the first absorber 40 is formed of a non-woven cloth or fiber fabric, the fuzz of fibers is created on the surface. As a result, the waste ink absorbed by the first absorber 40 may flow along the fuzz and may be deposited on the paper sheet. If the first absorber 40 has the recesses and projections on the surface, it becomes closer to the paper sheet transported on the medium support section 22 at the projections, which increases a risk that the fuzz is in contact with the paper sheet and smudges the paper sheet. The conductive member 31 having a flat surface can ensure a distance between the first absorber 40 and the paper sheet, preventing the fuzz on the surface of the first absorber 40 from being in contact with the paper sheet, and thus reducing the risk of the waste ink absorbed by the first absorber 40 from being deposited on the paper sheet.

Operation of Electric Field Generating Unit during Continuous Recording

In a recording job by which recording is continuously performed on a plurality of paper sheets (hereinafter, also referred to as continuous recording), the target for formation of the electric field during recording by the electric field generating unit 30 can be thinned out. For example, while recording is performed on the first paper sheet, the electric field generating unit 30 is operated by control described above in conjunction with FIGS. 11 to 13 to form the electric field to thereby attract and absorb mist by the first absorber 40. Then, electric field formation by the electric field generating unit 30 is turned off, leaving an interval of one or more paper sheets, and then electric field formation by the electric field generating unit 30 is again performed. That is, the control section 32 switches on and off of application of voltage to the conductive member 31 for every predetermined number of paper sheets to thereby intermittently perform formation of the electric field by the electric field generating unit 30.

Thus, in continuous recording, the target for formation of the electric field during recording by the electric field generating unit 30 can be thinned out, and thus the frequency of formation of the electric field can be reduced. Accordingly, the occurrence of problems described below due to application of high voltage to the conductive member 31 can be reduced.

One of the problems by application of high voltage to the conductive member 31 is a decrease in recording quality, which occurs when ink droplets ejected for recording onto the paper sheet are strongly attracted toward the conductive member 31. Other problems include nozzle missing, which occurs when the satellite droplets (positively charged) separated from the ink droplets ejected from the recording head 20 are deposited on the nozzle openings of the nozzle row 28 on the negatively charged recording head 20.

Further, in addition to switching on and off of application of voltage to the conductive member 31 for every predetermined number of paper sheets, the frequency of formation of electric field by the electric field generating unit 30 during recording can be reduced by switching on and off of application of voltage to the conductive member 31 depending on the number of passes of reciprocation of the carriage 21. For example, electric field generation control described in conjunction with FIG. 13 may be performed on the leading end and the trailing end of the paper sheet, while electric field generation control between the leading end and the trailing end of the paper sheet, that is, the control described in conjunction with FIGS. 11 and 12 may be performed in such a manner that the electric field generation control described in conjunction with FIGS. 11 and 12 is performed when the number of passes of the carriage 21 is an even number and is not performed when the number of passes of the carriage 21 is an odd number. Alternatively, electric field generation control may be performed only when the carriage 21 moves from the home position to the opposite side (FIG. 11), or only when the carriage 21 moves to the home position from the side opposite to the home position (FIG. 12). These can also be used to reduce the frequency of formation of the electric field during recording to thereby prevent a decrease in recording quality and nozzle missing caused by application of high voltage to the conductive member 31.

Other Configurations of Printer

Voltage Application to Conductive Member when Main Body Cover is in Open State

When the main body cover 3 that openably closes the apparatus main body 2 is in the open state, voltage application to the conductive member 31 is off. Specifically, the printer 1 includes an opening/closing sensor (not shown in the figure) that detects opening and closing of the main body cover 3, and the control section 32 (FIG. 3) turns off voltage application to the conductive member 31 when the opening/closing sensor detects the open state of the main body cover 3, that is, when the main body cover 3 is open.

The main body cover 3 is opened in maintenance for removing a paper jam or the like. During the maintenance, an operator usually puts his/her hand inside the apparatus main body 2. If a voltage is applied to the conductive member 31, there is a risk of electric shock when an operator's hand unintentionally touches the conductive member 31. When the main body cover 3 is in the open state, voltage application to the conductive member 31 can be turned off to thereby reduce or avoid a risk of electric shock during maintenance inside the apparatus main body 2.

Wiping on Nozzle Forming Surface

On the home position (−X axis direction side) of the movement region of the carriage 21, a wiper 38 (FIG. 4) is provided as a wiping unit that cleans the nozzle forming surface 29. The wiper 38 is configured to move, for example, relative to the nozzle forming surface 29 to wipe the nozzle forming surface 29.

More specifically, the wiper 38 is fixed to the apparatus main body 2 side and is configured to wipe the nozzle forming surface 29 while being in contact with the nozzle forming surface 29 when the carriage 21 moves from the +X axis direction side to the home position or when the carriage 21 moves from the home position to the +X axis direction side.

Further, the wiper 38 is configured to be movable between a contact state in which it is in contact with the nozzle forming surface 29 and a non-contact state in which it is separated from the nozzle forming surface 29. When the wiper 38 is in the contact state, the nozzle forming surface 29 is wiped as the carriage 21 moves. On the other hand, when the wiper 38 is in the non-contact state, the nozzle forming surface 29 is not wiped even if the carriage 21 moves. Accordingly, wiping of the nozzle forming surface 29 can be performed not every pass (one reciprocation of the carriage 21), but once in a plurality of passes. For example, wiping of the nozzle forming surface 29 can be performed for every predetermined number of print sheets depending on the type or size of the paper sheet.

The wiper 38 can wipe the nozzle forming surface 29 on a regular basis to thereby reduce nozzle missing caused by deposition of mist or satellite droplets on the nozzle forming surface 29 of the recording head 20. Further, the wiper 38 can also be configured such that the wiper 38 itself moves relative to the nozzle forming surface 29 (stationary) and wipes the nozzle forming surface 29 while the carriage 21 stops at the home position.

Second Absorber

Figure 14:
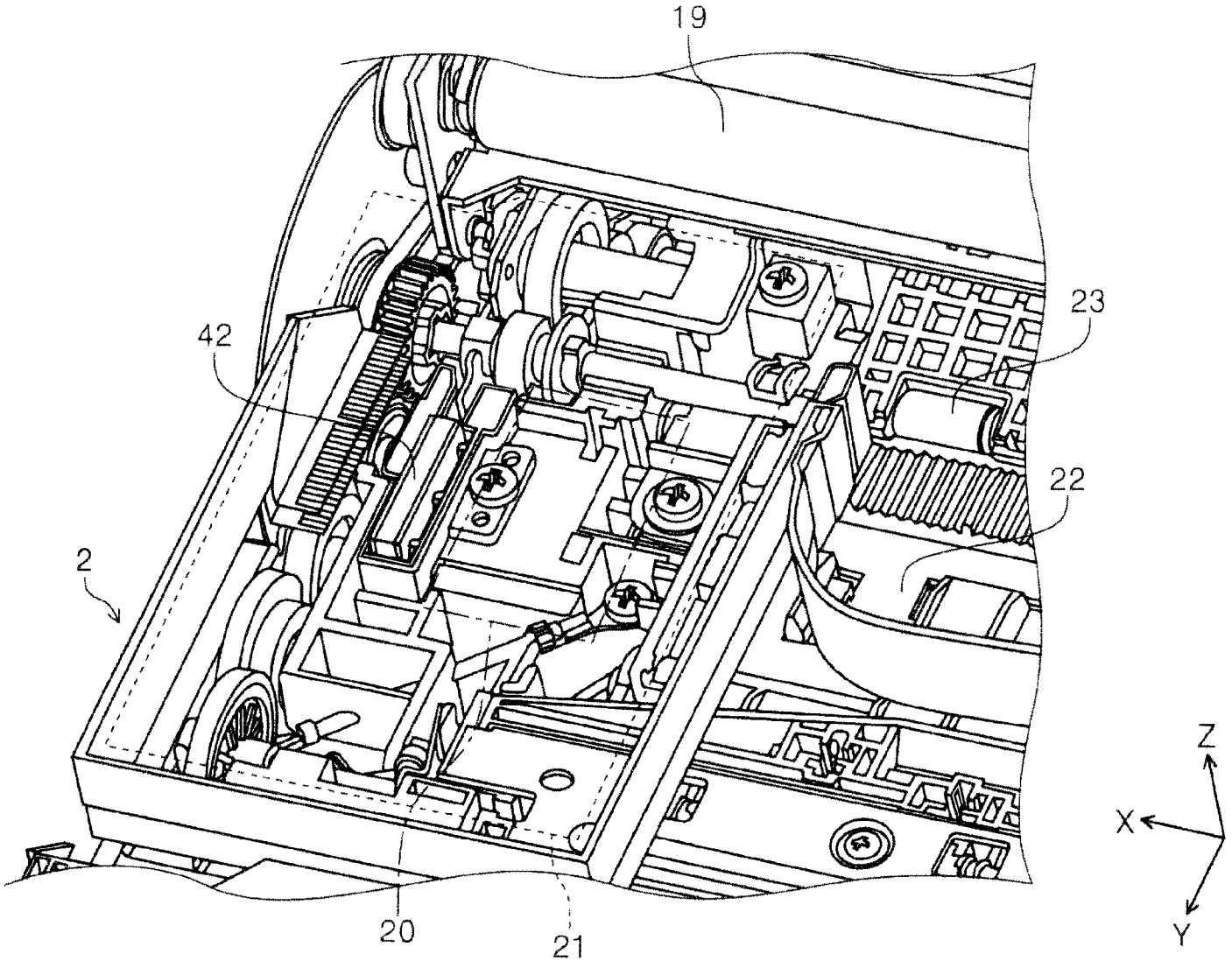
FIG. 14 is a view which illustrates a second absorber disposed in the apparatus main body.
Figure 15:
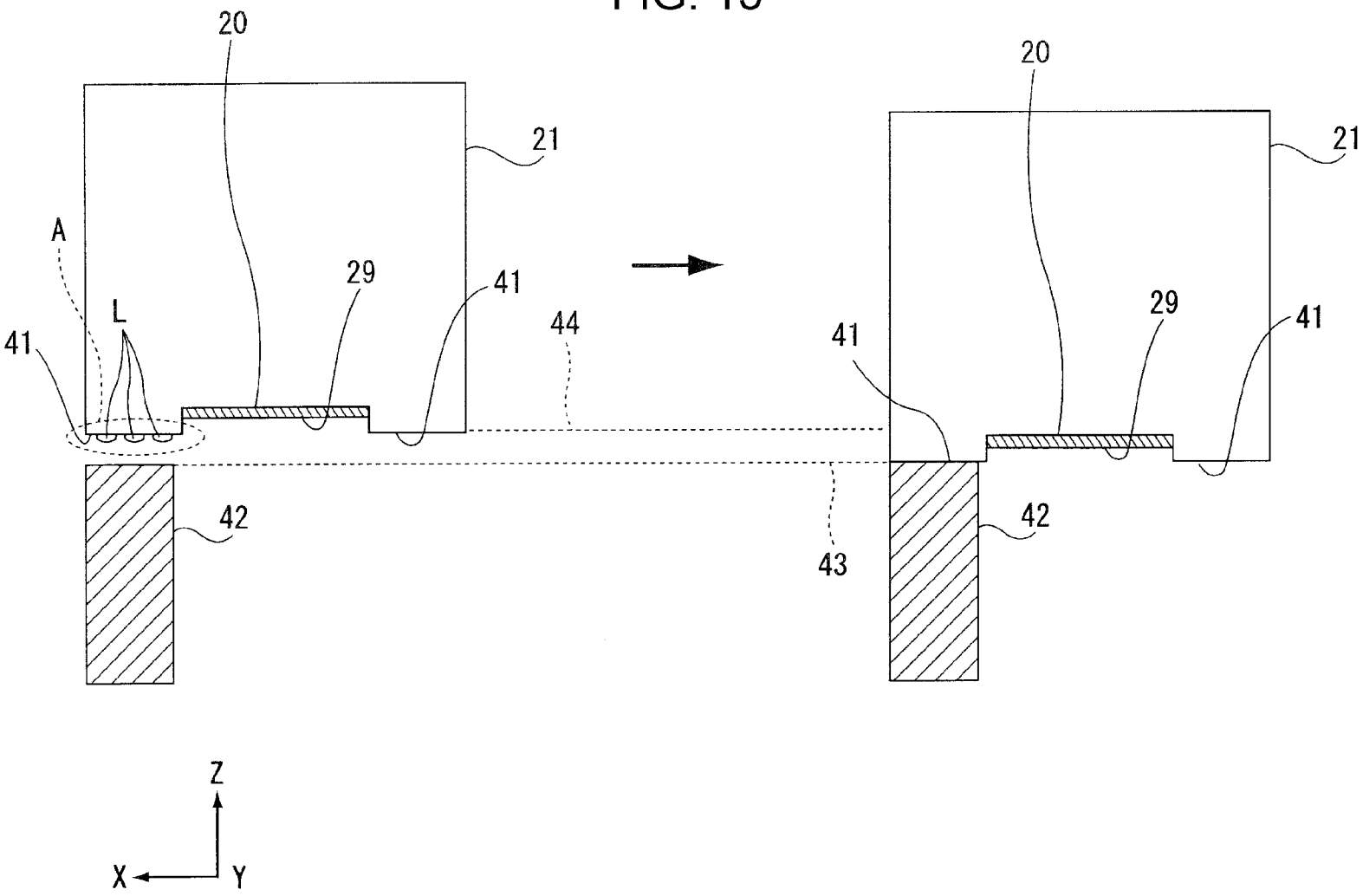
FIG. 15 is a view which illustrates an advanced state and a retreated state of the carriage.

Referring to FIGS. 14 and 15, a second absorber 42 will be described. FIG. 14 is a view which illustrates the second absorber disposed in the apparatus main body. FIG. 15 is a view which illustrates an advanced state and a retreated state of the carriage. The second absorber 42 (FIG. 14) that can absorb ink is disposed on the end in the +X axis direction side in the movement region of the carriage 21 and inside the movement region of the carriage 21. The second absorber 42 is a member for absorbing liquid formed of the mist deposited or accumulated on the bottom 41 of the carriage 21.

The second absorber 42 is positioned on the end (+X axis direction side) opposite to the home position. In FIG. 14, the position of the carriage 21 on the end in the +X axis direction in the movement region of the carriage 21 is indicated by the dotted line. Further, the position of the recording head 20 is indicated by the dot and dashed line.

The carriage 21 is configured to be advanced and retreated relative to the medium support section 22, that is, movable in the Z axis direction so that it can assume an advanced state (right figure in FIG. 15) in which at least part of the bottom 41 of the carriage 21 is in contact with the second absorber 42 and a retreated state (left figure in FIG. 15) in which the carriage 21 is retreated from the advanced state and separated from the second absorber 42. Further, the position indicated by reference character 43 in the right figure in FIG. 15 is a height position of the bottom 41 of the carriage 21 in the advanced state, while a position indicated by reference character 44 in the left figure in FIG. 15 is a height position of the bottom 41 of the carriage 21 in the retreated state. The carriage 21 assumes the retreated state (left figure in FIG. 15) during recording, and the bottom 41 is not in contact with the second absorber 42 even if it reciprocates in the X axis direction.

When the carriage 21 reciprocates a plurality of passes during recording, the mist suspended without being absorbed by the first absorber 40 may be deposited on the bottom 41 of the carriage 21. The deposited mist forms liquid droplets when aggregated (indicated by reference character L in the left figure in FIG. 15), and the liquid droplets L may drop on and smudge the paper sheet. In order to avoid the above problem, the carriage 21 can be in the advanced state (right figure in FIG. 15) on the end in the +X axis direction in the movement region of the carriage 21, for example, every predetermined number of passes of the carriage 21. Accordingly, the liquid droplets L originated from mist deposited on the bottom 41 of the carriage 21 can be absorbed by the second absorber 42 to thereby reduce or avoid a risk of the liquid droplets L dropping on the paper sheet.

In the present embodiment, the second absorber 42 is in contact with a part A of the bottom 41 of the carriage 21 in the advanced state, which is located on the end (in the +X axis direction side opposite to the home position) with respect to the nozzle forming surface 29 (see FIG. 10 as well as FIG. 15). Accordingly, the liquid droplets L originated from mist deposited on the part A can be absorbed by the second absorber 42. Further, a portion of the nozzle forming surface 29 in the −X axis direction can be configured to be wiped when wiping of the nozzle forming surface 29 by the wiper 38 is performed on a portion close the home position. As a matter of course, a configuration can also be possible in which the second absorber 42 is provided on the home position side so that the liquid droplets deposited on a portion of the nozzle forming surface 29 in the −X axis direction can be absorbed when the carriage 21 is in the advanced state in the home position.

In addition, it should be noted that the invention is not limited to the above embodiments. Various modifications are contemplated within the scope of the invention as defined in the appended claims, and these should be included in the scope of the invention.

The entire disclosure of Japanese Patent Application No. 2017-136276, filed Jul. 12, 2017 is expressly incorporated by reference herein.

What is claimed is:

1. A recording apparatus comprising:

a recording head having a nozzle that ejects liquid onto a medium transported; and an electric field generating unit that forms an electric field between a nozzle forming surface of the recording head and a nozzle facing section that faces the nozzle forming surface, wherein the electric field generating unit has a conductive member and is configured to form the electric field between the nozzle forming surface and the nozzle facing section by applying a voltage to the conductive member, and, during borderless recording in which liquid is ejected on inside and outside of an edge of the medium, applies an increased voltage in a liquid discarded region outside the edge compared to a voltage applied in the recording region other than the liquid discarded region.

2. The recording apparatus according to claim 1, wherein the electric field generating unit applies an increased voltage in an end recording region inside the edge, in addition to the liquid discarded region, compared to a voltage applied in the recording region inside the end recording region.

3. The recording apparatus according to claim 1, further comprising:

a carriage which includes the recording head and is configured to reciprocate in a scan direction of the recording head, wherein the electric field generating unit is configured to vary an applied voltage, and the voltage applied to the conductive member is changed depending on the position of the carriage.

4. The recording apparatus according to claim 3, wherein voltage application to the conductive member is switched between on and off depending on a number of passes of reciprocation of the carriage.

5. The recording apparatus according to claim 1, wherein a target of formation of the electric field by the electric field generating unit is thinned out during recording in a recording job that continuously performs recording on a plurality of media.

6. The recording apparatus according to claim 1, wherein the nozzle facing section includes an absorber that absorbs liquid.

* * * * *